US005369229A

United States Patent [19]

Agut Sanz

[11] Patent Number: 5,369,229

[45] Date of Patent: Nov. 29, 1994

[54] MECHANICAL INTERLOCK FOR CONTACTOR BANKS

[75] Inventor: Juan Agut Sanz, Terrassa, Spain

[73] Assignee: Agut, S.A., Terrassa, Spain

[21] Appl. No.: 19,125

[22] Filed: Feb. 17, 1993

[30] Foreign Application Priority Data

Feb. 18, 1992 [ES] Spain ..... 9200351

[51] Int. Cl.[5] ..... H01H 9/26

[52] U.S. Cl. ..... 200/50 C; 335/132; 335/160

[58] Field of Search ..... 200/50 C; 335/132, 160

[56] References Cited

U.S. PATENT DOCUMENTS 3,210,491 5/1965 DiMarco ..... 200/50 C 5,164,694 11/1992 De Vault et al. ..... 335/132

FOREIGN PATENT DOCUMENTS 0214630 3/1987 European Pat. Off. .

*Primary Examiner*—J. R. Scott

*Attorney, Agent, or Firm*—Darby & Darby

[57] ABSTRACT

The locking mechanism is inserted between two contactor banks and comprises two sliding pieces connected to a pair of tillable cams, which are biased towards an inoperative position by a spring. The cams are connected to the sliding pieces themselves by pivot emerging from each one of them. The pivot is located in a transversal throat of the sliding pieces themselves. When one of these pieces moves, the respective cam tilts and comes in between and blocks the other one, preventing the respective sliding piece associated to the latter from being able to move. Thus, the pulsator of the other contactor bank will not be able to be operated.

8 Claims, 3 Drawing Sheets

MECHANICAL INTERLOCK FOR CONTACTOR BANKS

FIELD OF THE INVENTION

The present invention relates to a mechanical locking for contactor banks to prevent two specific contactors from being activated simultaneously, either because the respective functions are incompatible or because they define an invariable order sequence.

BACKGROUND OF THE INVENTION

In specific installations, such as a heating installation for example, it is necessary that two of the elements that come to form part of the operation must be associated, as far as hookup and start are concerned, in such a way that one of them should always start operating after the other, and the latter should not disconnect after the second element.

In this sense, the electric resistor and the ventilator of a heating installation can be cited as an example. The resistor should not be connected without the corresponding ventilator being activated. In other words, the connecting of the electric resistor when the ventilator is not operating should be prevented, while when the ventilator is operating activation of the electric resistor is optional and, in the connecting position of the electric resistor, the ventilator cannot be disconnected.

In such a case it is convenient that the switch of the electric resistor is subjected to the active position of the ventilator switch.

SUMMARY OF THE INVENTION

The mechanical locking for contactor banks of the present invention operates in such a way that the operation of any of the contactors of a pair of banks between which the locking mechanism of the present invention is inserted, prevents the operating of the other contactors.

In this sense, the mechanical locking establishes the functional dependency concerning the interrelated contactors, and is formed from a pair of sliding pieces functionally connected to both pivotable cams, in such a way that the runs of the cams mutually interfere with each other, so that when one of the cams is in an end position, movement of the other cam is prevented and vice versa.

The sliding pieces are mounted on the general frame of the device, are guided longitudinally, and each one of the them governs the switch of a contactor bank. The connection of the cams to the sliding pieces themselves is carried out by means of a pivot that emerges or protrudes sideways from each one of the cams and is received in a transversal throat of the respective sliding piece, establishing the transformation of the linear movement of each sliding piece into a pivoting or tiltable movement of the corresponding cam.

The mechanism is complemented with some springs that permanently pull or bias the cams, in such a way that the cams occupy a normal rest or inoperative position. The device includes some auxiliary and floating electric contacts placed in transference with terminals mounted on the general frame.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Referring now to FIGS. 1–4, the mechanical lock for contactor banks, is illustrated having two sliding pieces 1 and 2, which are longitudinally guided on a general frame 3. The sliding pieces 1 and 2, which are elongated and are located axially opposite one another, are connected to both tiltable or pivotable cams 4, the tilting or pivot point of each one of the cams being the shaft 5, which is fixed to the frame 3.

The cams 4, when pivoted, both mutually interfere with each other, in such a way that in the end position of one of the cams 4, movement of the other one of the cams 4 will be prevented and vice versa.

Figure 5:
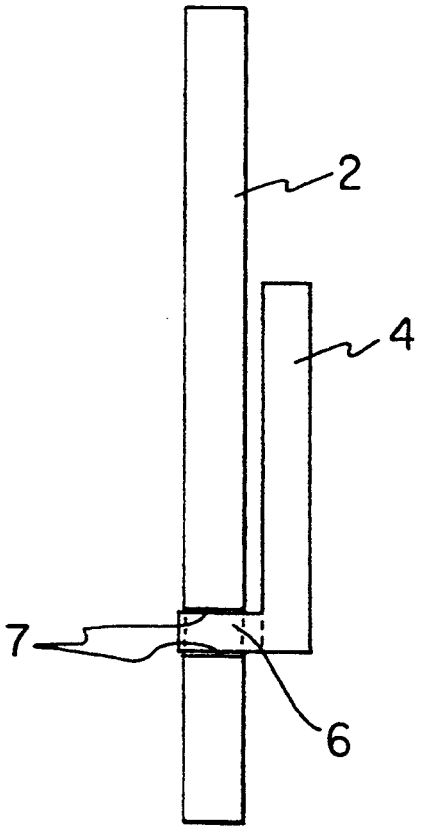
FIG. 5 shows a side view of the schematic of FIG. 4 with the pivot of the cam housed in transversal throat of the sliding piece.

The connection between each sliding piece 1, 2 and its corresponding cam 4, 4 is achieved by a pivot 6. Pivot 6 protrudes sideways from the respective cam 4. Pivot 6 is housed in a transversal throat 7 provided in the sliding piece itself 1 or 2 (See FIG. 5). The coupling between sliding piece 1, 2 and the respective cam 4, 4 establishes the transformation of the linear movement of the sliding piece 1 or 2 into pivoting movement of the respective cam 4.

Figure 1:
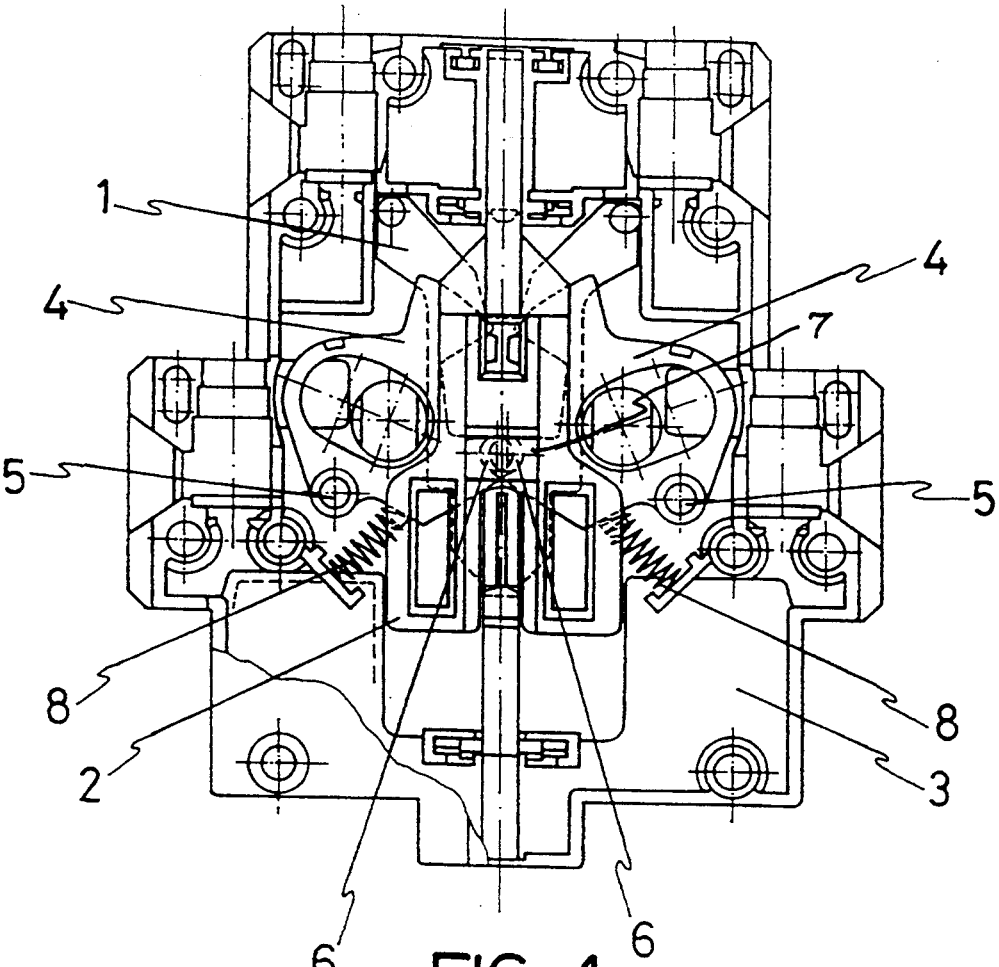
FIG. 1 shows a plan view of the two sliding pieces, as well as the two cams, the springs connected to the cams and the general frame where the entire mechanism is mounted.
Figure 2:
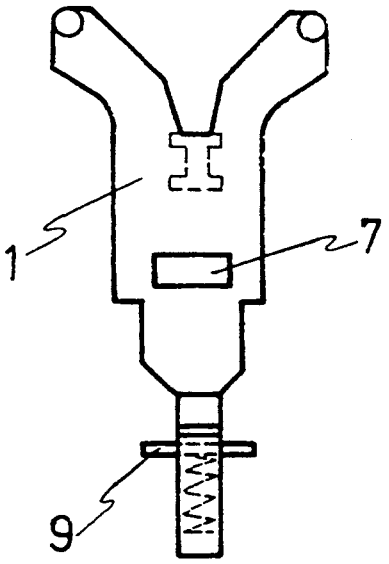
FIGS. 2 and 3 show both schematic longitudinal representations of the two longitudinally moveable guided sliding pieces on the general frame of the present invention.
Figure 3:
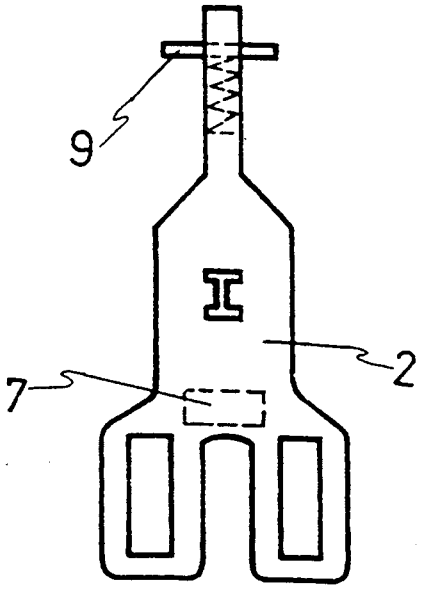
Figure 4:
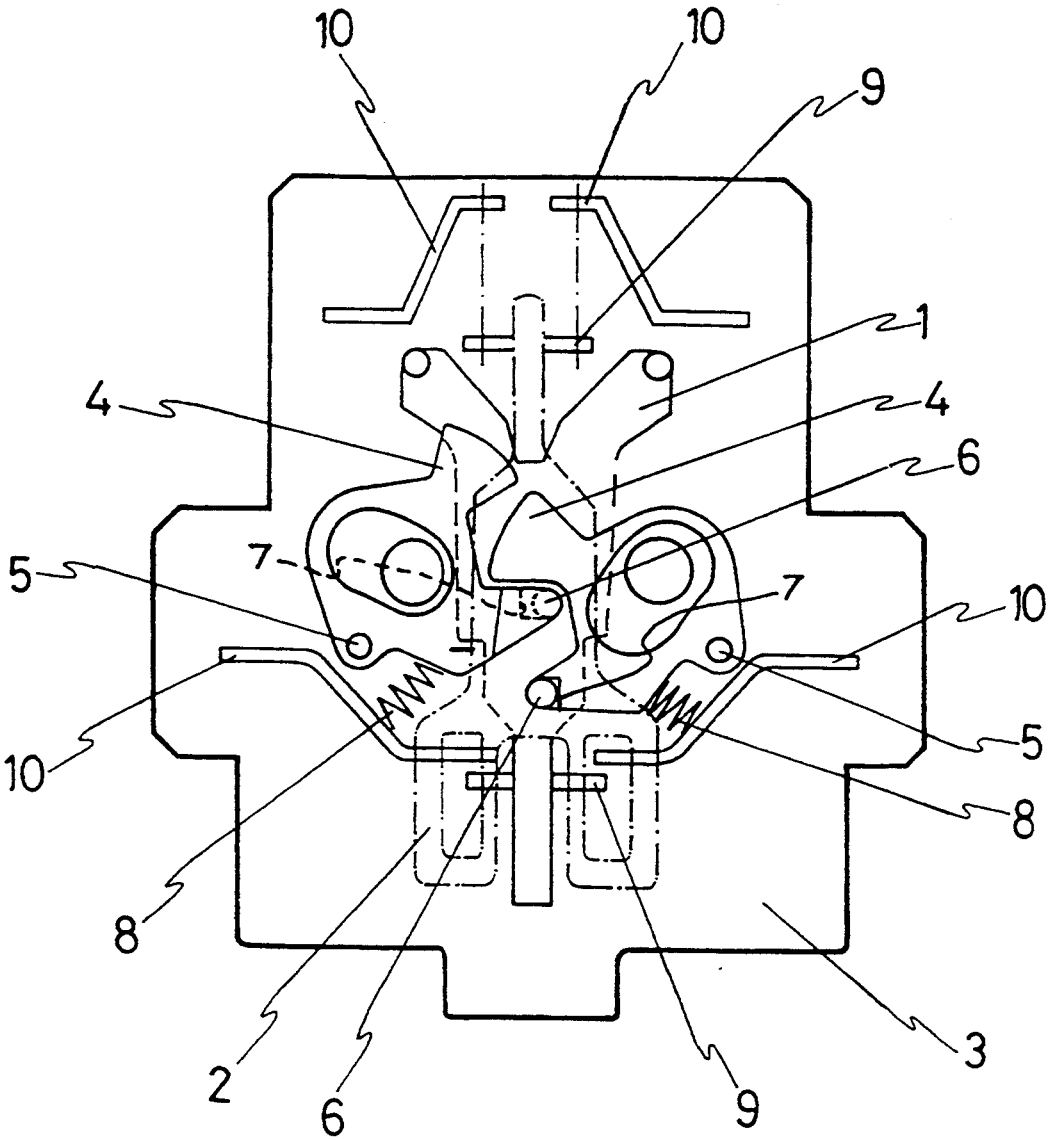
FIG. 4 shows a plan schematic representation of the contour of the frame, as well as the assembly of the sliding pieces, cams and tilting points of the cams.

Each of the cams 4 is biased towards an inoperative position by means of a tension spring 8, as is clearly shown in FIG. 1 and 4. The sliding pieces 1 and 2 are connected to the switch of a corresponding contactor bank. The sliding pieces 1, 2 are connected, in an operative way to the auxiliary and floating electric contacts 9, which are placed in transference with the terminals 10 that are mounted on the frame itself 3.

In this way, when one of the sliding pieces 1 or 2 is activated by means of the pulsator of the corresponding contactor bank, the axial or forward movement thereof will determine the pivoting of the respective cam 4, in such a way that in the pivoted position the body of the cam 4 itself interferes with one part of the other cam preventing the latter from pivoting, and thus preventing the other sliding piece from being able to move forward. In other words, the pulsator of the other contactor bank cannot be operated, until the mechanism returns to its initial inoperative position, as is shown in FIG. 1.

I claim:

1. A mechanical locking device for contactor banks comprising:

a frame;

a first sliding piece and a second sliding piece being linearly moveable with respect to said frame from a first position where a contactor is switched off to a second position where a contactor is switched on;

a first cam being pivotably connected to said frame, said first cam being operatively connected to said first sliding piece such that said first cam pivots when said first sliding piece moves from said first position to said second position;

a second cam being pivotably connected to said frame, said second cam being operatively connected to said second sliding piece such that said second cam pivots when said second sliding piece moves from said first position to said second position; and said first cam having a surface which prevents the pivoting of the second cam when said first sliding piece is disposed in said second position, said second cam having a surface which prevents the pivoting of said first cam when said second sliding piece is disposed in said second position.

2. The mechanical locking device for contactor banks, according to claim 1, wherein the cams are operatively connected to the sliding pieces by means of a pivot that protrudes from the respective cam and is received in a transversal throat in the corresponding sliding piece and, the operative connection transforms the linear movement of the respective sliding piece to a pivoting movement of the respective cam.

3. The mechanical locking device for contactor banks, according to claim 2, wherein said cams are biased by respective springs towards a position corresponding to the first position of the respective sliding piece.

4. The mechanical locking device for contactor banks, according to claim 3, wherein the sliding pieces include auxiliary floating electric contacts that are placed in connection with terminals mounted on tile frame when said sliding piece is in said second position.

5. The mechanical locking device for contactor banks, according to claim 1, wherein said cams are biased by respective springs towards a position corresponding to the first position of the respective sliding piece.

6. The mechanical locking device for contactor banks, according to claim 5, wherein said sliding pieces include auxiliary floating electric contacts that are placed in connection with terminals mounted on the frame when said sliding piece is in said second position.

7. The mechanical locking device for contactor banks, according to claim 2, wherein said sliding pieces include auxiliary floating electric contacts that are placed in connection with terminals mounted on the frame when said sliding piece is in said second position.

8. The mechanical locking device for contactor banks, according to claim 1, wherein said sliding pieces include auxiliary floating electric contacts that are placed in connection with terminals mounted on the frame when said sliding piece is in said second position.

* * * * *